US010538892B2

(12) United States Patent
Cress et al.

(10) Patent No.: US 10,538,892 B2
(45) Date of Patent: Jan. 21, 2020

(54) HYDRAULIC IMPACT HAMMER SYSTEMS AND METHODS

(71) Applicant: American Piledriving Equipment, Inc., Kent, WA (US)

(72) Inventors: Steven N. Cress, Renton, WA (US); Joseph M. Klekotka, Seattle, WA (US)

(73) Assignee: AMERICAN PILEDRIVING EQUIPMENT, INC., Kent, WA (US)

( * ) Notice: Subject to any disclaimer, the term of this patent is extended or adjusted under 35 U.S.C. 154(b) by 419 days.

(21) Appl. No.: 15/199,695

(22) Filed: Jun. 30, 2016

(65) Prior Publication Data

US 2018/0002886 A1 Jan. 4, 2018

(51) Int. Cl.

| | |
|---|---|
| ***E02D 7/14*** | (2006.01) |
| ***B25D 9/04*** | (2006.01) |
| ***E02D 7/10*** | (2006.01) |
| ***E02D 7/12*** | (2006.01) |
| ***E02D 7/26*** | (2006.01) |

(52) U.S. Cl.

CPC ..... *E02D 7/14* (2013.01); *B25D 9/04* (2013.01); *E02D 7/10* (2013.01); *E02D 7/125* (2013.01); *E02D 7/26* (2013.01)

(58) Field of Classification Search

CPC .. E02D 7/10; E02D 7/125; E02D 7/14; E02D 7/26; E02D 7/12; B25D 9/16; B25D 9/20; B25D 9/04

USPC ..... 173/200, 2–11, 90, 176–183, 184, 213; 405/228

See application file for complete search history.

(56) References Cited

U.S. PATENT DOCUMENTS

| | | | | |
|---|---|---|---|---|
| 5,015 | A | 3/1847 | Ingalls | |
| 48,515 | A | 7/1865 | Campbell et al. | |
| 369,176 | A | 8/1887 | Gerstein | |
| 400,209 | A | 3/1889 | Haskins | |
| 628,962 | A | 7/1899 | Speer | |
| 999,334 | A | 8/1911 | Pearson | |
| 1,103,104 | A * | 7/1914 | Tismer | B25D 9/20 91/239 |
| 1,128,808 | A | 2/1915 | Manoogian | |

(Continued)

FOREIGN PATENT DOCUMENTS

| | | |
|---|---|---|
| CN | 2538852 | 3/2003 |
| CN | 101182714 A | 5/2008 |

(Continued)

OTHER PUBLICATIONS

"Kony Drain Board," undated, 1 page.
"The 1st Report on the Treatment of Soft Foundation in Juck Hyun Industrial Site", Ref. Nos. APE00854-APE00856, 1976, 3 pages.

(Continued)

*Primary Examiner* — Alexander M Valvis
*Assistant Examiner* — Katie L Gerth
(74) *Attorney, Agent, or Firm* — Michael R. Schacht; Schacht Law Office, Inc.

(57) ABSTRACT

A hydraulic impact hammer for striking a pile has a main housing, a ram supported, a coupler rod, a conversion housing, a hydraulic actuator, and a ram connector. The hydraulic actuator defines an actuator rod, a lifting head, and a lift connector. The lifting head defines an upper wall and a lower wall. The lift connector attaches the actuator rod to the upper wall of the lifting head. The ram connector attaches the coupler rod to the lower wall of the lifting head. Operation of the hydraulic actuator raises and lowers the ram to strike the pile.

18 Claims, 5 Drawing Sheets

(56) References Cited

U.S. PATENT DOCUMENTS 1,159,303 A * 11/1915 Waugh ..... B25D 9/20 91/239
1,213,800 A 1/1917 Piper
1,288,989 A 12/1918 Rees
1,294,154 A 2/1919 Payne
1,322,470 A 11/1919 Schenk
1,348,994 A 8/1920 Heckle
1,464,231 A 8/1923 Yezek
1,654,093 A 12/1927 Reid
1,702,349 A 2/1929 Krell
1,748,555 A 2/1930 Kinney
1,762,037 A 6/1930 Taylor
1,769,169 A 7/1930 Thornley
1,787,000 A 12/1930 Hunt
1,903,555 A 4/1933 Robertson
1,914,899 A 6/1933 Syme
1,988,173 A 1/1935 Kersting
2,068,045 A 1/1937 Wohlmeyer
2,239,024 A 4/1941 Vance
2,345,795 A * 4/1944 Collyer ..... E02D 13/10 173/130
2,577,252 A 12/1951 Kjellman
2,723,532 A * 11/1955 Smith ..... E02D 13/10 173/131
2,755,783 A 7/1956 Kupka
2,804,856 A * 9/1957 Spurlin ..... B21J 7/26 123/46 R
2,842,972 A 7/1958 Houdart
2,859,628 A 11/1958 Arko
2,882,690 A 4/1959 Frederick
2,904,964 A 9/1959 Kupka
2,952,132 A 9/1960 Urban
3,001,515 A 9/1961 Haage
3,004,389 A 10/1961 Muller
3,034,304 A 5/1962 Upson
3,094,007 A 6/1963 Luhrs
3,100,382 A 8/1963 Muller
3,101,552 A 8/1963 Tandler
3,106,258 A 10/1963 Muller
3,108,503 A 10/1963 Murek
3,115,198 A 12/1963 Kuss
3,149,851 A 9/1964 Adams
3,172,485 A 3/1965 Spannhake et al.
3,177,029 A 4/1965 Larson
3,193,026 A 7/1965 Kupka
3,227,483 A 1/1966 Guild et al.
3,243,190 A 3/1966 Peregrine
3,267,677 A 8/1966 Bollar
3,289,774 A 12/1966 Bodine, Jr.
3,300,987 A 1/1967 Maeda
3,313,376 A 4/1967 Holland, Sr.
3,371,727 A 3/1968 Belousov et al.
3,381,422 A 5/1968 Olson
3,391,435 A 7/1968 Lebelle
3,394,766 A 7/1968 Lebelle
3,412,813 A 11/1968 Johnson
3,447,423 A 6/1969 Henry
3,450,398 A 6/1969 Barnes
3,460,637 A 8/1969 Schulin
3,513,587 A 5/1970 Fischer
3,530,947 A 9/1970 Gendron et al.
3,577,645 A 5/1971 Zurawski
3,583,497 A 6/1971 Kossowski et al.
3,616,453 A 10/1971 Philpot
3,620,137 A 11/1971 Prasse
3,638,738 A 2/1972 Varnell
3,679,005 A 7/1972 Inaba et al.
3,684,037 A 8/1972 Bodine
3,686,877 A 8/1972 Bodin
3,711,161 A 1/1973 Proctor et al.
3,720,435 A 3/1973 Leyn
3,734,209 A 5/1973 Haisch et al.
3,786,874 A 1/1974 Demichelis et al.
3,789,930 A 2/1974 Nishimura et al.
3,797,585 A 3/1974 Ludvigson
3,822,969 A 7/1974 Kummel
3,828,864 A 8/1974 Haverkamp et al.
3,854,418 A 12/1974 Bertin
3,861,664 A 1/1975 Durkee
3,865,501 A 2/1975 Kniep
3,871,617 A 3/1975 Majima
3,874,244 A 4/1975 Rasmussen et al.
3,891,186 A 6/1975 Thorsell
3,907,042 A 9/1975 Halwas et al.
3,952,796 A 4/1976 Larson
3,959,557 A 5/1976 Berry
3,967,688 A 7/1976 Inenaga et al.
3,975,918 A 8/1976 Jansz
3,991,833 A 11/1976 Ruppert
3,998,063 A 12/1976 Harders
4,018,290 A 4/1977 Schmidt
4,029,158 A 6/1977 Gerrish
4,033,419 A 7/1977 Pennington
4,067,369 A 1/1978 Harmon
4,076,081 A * 2/1978 Schnell ..... E02D 7/125 173/137
4,082,361 A 4/1978 Lanfermann
4,099,387 A 7/1978 Frederick et al.
4,100,974 A 7/1978 Pepe
4,102,408 A 7/1978 Ludvigson
4,109,475 A 8/1978 Schnell
4,113,034 A 9/1978 Carlson
4,119,159 A 10/1978 Arentsen
4,143,985 A 3/1979 Axelsson et al.
4,154,307 A 5/1979 Gendron et al.
4,155,600 A 5/1979 Lanfermann et al.
4,166,508 A 9/1979 van den Berg
4,180,047 A 12/1979 Bertelson
4,187,917 A 2/1980 Bouyoucos
4,195,698 A 4/1980 Nakagawasai
4,248,550 A 2/1981 Blaschke et al.
4,262,755 A 4/1981 Kuhn
4,274,761 A 6/1981 Boguth
4,312,413 A 1/1982 Loftis
4,362,216 A 12/1982 Jansz
4,366,870 A 1/1983 Frederick
4,367,800 A 1/1983 Arentsen
4,375,927 A 3/1983 Kniep
4,380,918 A 4/1983 Killop
4,382,475 A 5/1983 Suzuki
4,397,199 A 8/1983 Jahn
4,421,180 A 12/1983 Fleishman et al.
4,428,699 A 1/1984 Juhola
4,430,024 A 2/1984 Guild et al.
4,436,452 A 3/1984 Bodine
4,455,105 A 6/1984 Juhola
4,465,145 A 8/1984 Kuhn
4,473,123 A * 9/1984 Ranft ..... E02D 7/125 173/1
4,484,638 A * 11/1984 West ..... B21J 7/28 173/200
4,497,376 A 2/1985 Kurylko
4,497,377 A * 2/1985 Haytayan ..... A22B 3/02 173/15
4,505,614 A 3/1985 Anschutz
4,519,729 A 5/1985 Clarke et al.
4,537,527 A 8/1985 Juhola
4,547,110 A 10/1985 Davidson
4,553,443 A 11/1985 Rossfelder et al.
4,601,615 A 7/1986 Cavalli
4,603,748 A 8/1986 Rossfelder et al.
4,624,325 A 11/1986 Steiner
4,626,138 A 12/1986 Boyes
4,627,768 A 12/1986 Thomas et al.
4,632,602 A 12/1986 Hovnanian
4,637,475 A 1/1987 England et al.
4,645,017 A 2/1987 Bodine
4,687,026 A 8/1987 Westman
4,725,167 A 2/1988 Merjan
4,735,270 A 4/1988 Fenyvesi
4,755,080 A 7/1988 Cortlever et al.
4,757,809 A 7/1988 Koeneman et al.
4,758,148 A 7/1988 Jidell
4,768,900 A 9/1988 Burland

(56) References Cited

U.S. PATENT DOCUMENTS 4,799,557 A 1/1989 Jacquemet
4,813,814 A 3/1989 Shibuta et al.
4,844,661 A 7/1989 Martin et al.
4,863,312 A 9/1989 Cavalli
4,877,353 A * 10/1989 Wisotsky, Sr. ..... B09B 1/002 588/17
4,915,180 A 4/1990 Schisler
4,961,471 A 10/1990 Ovens
4,974,997 A 12/1990 Sero et al.
4,989,677 A 2/1991 Lam
4,993,500 A 2/1991 Greene et al.
5,004,055 A * 4/1991 Porritt ..... E21B 7/24 175/122
5,018,251 A 5/1991 Brown
5,018,905 A * 5/1991 Kinder ..... E02D 27/48 405/230
5,076,090 A 12/1991 Cetnarowski
5,088,565 A 2/1992 Evarts
5,107,934 A 4/1992 Atchison
5,117,925 A 6/1992 White
5,154,667 A 10/1992 Mauch et al.
5,161,625 A 11/1992 Seng
5,213,449 A 5/1993 Morris
5,253,542 A 10/1993 Houze
RE34,460 E 11/1993 Ishiguro et al.
5,263,544 A 11/1993 White
5,281,775 A 1/1994 Gremillion
5,343,002 A 8/1994 Gremillion
5,355,964 A 10/1994 White
5,375,897 A 12/1994 Gazel-Anthoine
5,385,218 A 1/1995 Migliori
5,409,070 A 4/1995 Roussy
5,410,879 A 5/1995 Houze
5,423,633 A 6/1995 Verstraeten
5,439,326 A 8/1995 Goughnour et al.
5,526,885 A 6/1996 Kuvshinov et al.
5,529,132 A 6/1996 Evarts
5,540,193 A 7/1996 Achten et al.
5,540,295 A 7/1996 Serrette
5,544,979 A 8/1996 White
5,549,168 A 8/1996 Sadler et al.
5,551,804 A 9/1996 Breaux et al.
5,562,169 A 10/1996 Barrow
5,609,380 A 3/1997 White
5,653,556 A 8/1997 White
5,658,091 A 8/1997 Goughnour et al.
5,727,639 A 3/1998 Jeter
5,788,419 A 8/1998 Whitty, Jr. et al.
5,794,716 A 8/1998 White
5,806,610 A 9/1998 Sapozhnikov
5,811,741 A 9/1998 Coast et al.
5,836,205 A 11/1998 Meyer
5,860,482 A 1/1999 Gremillion et al.
5,918,511 A 7/1999 Sabbaghian et al.
5,924,498 A 7/1999 Nilsen
5,934,835 A 8/1999 Whitty, Jr. et al.
6,003,619 A 12/1999 Lange
6,039,508 A 3/2000 White
6,056,070 A 5/2000 Shinohara et al.
6,102,133 A * 8/2000 Scheid ..... E02D 7/26 173/1
6,129,159 A 10/2000 Scott et al.
6,129,487 A 10/2000 Bermingham et al.
6,135,214 A * 10/2000 Last ..... E02D 7/10 173/128
6,155,353 A 12/2000 Ottestad
6,179,527 B1 1/2001 Goughnour
6,186,043 B1 2/2001 Callies
6,216,394 B1 4/2001 Fenelon
6,224,294 B1 * 5/2001 Mansfield ..... B63C 3/06 173/1
6,227,767 B1 5/2001 Mosing et al.
6,234,260 B1 5/2001 Coast et al.
6,250,426 B1 6/2001 Lombard
6,360,829 B1 3/2002 Naber et al.
6,364,577 B1 4/2002 Haney
6,378,951 B1 4/2002 Bouyoucos et al.
6,386,295 B1 5/2002 Suver
6,427,402 B1 8/2002 White
6,431,795 B2 8/2002 White
6,447,036 B1 9/2002 White
6,484,553 B1 11/2002 Devers
6,543,966 B2 4/2003 White
6,557,647 B2 5/2003 White
6,582,158 B1 6/2003 Van Stein
6,648,556 B1 11/2003 White
6,652,194 B2 11/2003 Ingle
6,672,805 B1 1/2004 White
6,691,797 B1 2/2004 Hart
6,732,483 B1 5/2004 White
6,736,218 B1 * 5/2004 White ..... E02D 7/125 173/135
6,752,043 B2 6/2004 Carlson
6,860,338 B2 3/2005 Salesse et al.
6,896,448 B1 5/2005 White
6,908,262 B1 6/2005 White
6,938,704 B2 * 9/2005 Berger ..... B25D 11/005 173/109
6,942,430 B1 9/2005 Suver
6,988,564 B2 1/2006 White
7,011,156 B2 * 3/2006 von Gynz-Rekowski ..... E21B 4/14 166/178
7,043,806 B2 5/2006 Schrock et al.
7,156,190 B2 * 1/2007 Ottestad ..... B25D 9/12 173/128
7,168,890 B1 1/2007 Evarts
7,392,855 B1 7/2008 White
7,404,449 B2 7/2008 Bermingham et al.
7,407,343 B2 8/2008 van Halteren et al.
7,591,612 B2 9/2009 Wong
7,694,747 B1 4/2010 White
7,708,499 B1 5/2010 Evarts et al.
7,726,913 B1 6/2010 Sjogren
7,824,132 B1 11/2010 White
7,854,571 B1 12/2010 Evarts
7,950,877 B2 5/2011 Evarts
7,972,083 B2 7/2011 Jones
8,070,391 B2 12/2011 White
8,181,713 B2 5/2012 White
8,181,716 B2 * 5/2012 Robson ..... B25D 17/08 173/210
8,186,452 B1 5/2012 White et al.
8,763,719 B2 * 7/2014 White ..... E02D 7/125 173/1
9,278,443 B2 * 3/2016 Robson ..... B25D 17/24
9,371,624 B2 * 6/2016 Suver ..... E02D 7/22
9,611,610 B2 * 4/2017 Suver ..... E02D 11/00
10,273,646 B2 * 4/2019 Cress ..... E02D 7/125
2002/0139550 A1 * 10/2002 Mewes ..... E02D 7/125 173/114
2003/0143036 A1 7/2003 Larsen, Jr.
2005/0013675 A1 1/2005 Bengston et al.
2005/0232708 A1 10/2005 White
2006/0052818 A1 3/2006 Drake et al.
2006/0113456 A1 6/2006 Miller
2006/0216118 A1 9/2006 Wong
2008/0310923 A1 12/2008 Jinnings et al.
2009/0129870 A1 5/2009 Jones
2010/0303552 A1 12/2010 Yingling et al.
2011/0162859 A1 7/2011 White
2011/0243668 A1 10/2011 White
2011/0252610 A1 10/2011 Evarts
2012/0114424 A1 5/2012 White
2014/0231115 A1 * 8/2014 Heichel ..... E02D 7/125 173/135
2017/0167104 A1 6/2017 Cress

FOREIGN PATENT DOCUMENTS

CN 107558472 A 1/2018
DE 4010357 10/1990

(56) References Cited

FOREIGN PATENT DOCUMENTS

| | | | | |
|---|---|---|---|---|
| DE | 4414190 | C1 * | 7/1995 | ..... E02D 7/10 |
| DE | 102006053482 | | 6/2008 | |
| EP | 0172960 | | 5/1986 | |
| EP | 362158 | | 4/1990 | |
| EP | 526743 | | 10/1993 | |
| FR | 838717 | | 3/1939 | |
| FR | 2560247 | | 8/1985 | |
| GB | 1066727 | | 4/1967 | |
| GB | 2003769 | | 3/1979 | |
| GB | 2023496 | | 1/1980 | |
| GB | 2028902 | | 3/1980 | |
| GB | 2043755 | | 10/1980 | |
| GB | 2060742 | | 5/1981 | |
| JP | 5494703 | | 7/1979 | |
| JP | 355098526 | | 7/1980 | |
| JP | 356034828 | | 4/1981 | |
| JP | 57169130 | | 10/1982 | |
| JP | 59228529 | A | 12/1984 | |
| JP | 61221416 | | 10/1986 | |
| JP | 0258627 | | 2/1990 | |
| JP | 497015 | A | 3/1992 | |
| JP | 473035 | | 6/1992 | |
| JP | 5246681 | | 9/1993 | |
| JP | 6136751 | | 5/1994 | |
| JP | 9328983 | A | 12/1997 | |
| KR | 1020010044658 | A | 5/2001 | |
| KR | 1020030017742 | A | 4/2003 | |
| NL | 42349 | | 1/1938 | |
| NL | 65252 | | 2/1950 | |
| NL | 7710385 | | 3/1978 | |
| NL | 7707303 | | 1/1979 | |
| NL | 7805153 | | 11/1979 | |
| NO | 46428 | | 4/1929 | |
| SU | 1027357 | | 7/1983 | |
| WO | 8707673 | | 12/1987 | |
| WO | 8805843 | | 8/1988 | |

OTHER PUBLICATIONS

American Piledriving Equipment, Inc., A series of photographs identified by Reference Nos. APE01147-APE01159, undated, 13 pages.

APE, "APE Model 8 Hydraulic Impact Hammer," 2000, 1 page.

CCPIT Patent and Trademark Law Office, Office Action and Search Report, Application No. 201210346475.7, dated Apr. 27, 2015, 15 pages.

International Construction Equipment, Inc., "Diesel Pile Hammers" brochure, Ref. No. DH4-1288-5C, undated, 6 pages.

International Construction Equipment, Inc., "Hydraulic Vibratory Driver/Extractors for Piling and Caisson Work," Ref. No. V7-0890-51, undated, 3 pages.

International Construction Equipment, Inc., "Hydraulic Vibratory Driver/Extractors for Piling and Caisson Work," undated, 10 pages.

International Searching Authority, "International Search Report", dated Jan. 28, 2011, 11 pages.

Japan Development Consultants, Inc., "Castle Board Drain Method" Japanese language brochure, Ref. Nos. APE00857-APE00863, Aug. 1976, 6 pages.

Korean language documents identified by Ref. Nos. APE00864-APE00891, dates from 1982-1997, 28 pages.

MKT Corporation, "Operating, Maintenance and Parts Manual for MS350 and MS500 Single-Acting Pile Hammers," 12 pages.

MKT Geotechnical Systems, Manual No. 01807: "Operating, Maintenance and Parts manual for MS350 and MS500 Single-Acting Pile Hammers," undated, 12 pages.

Report identifying systems for driving mandrels carrying wick drain material into the earth, Ref. Nos. APE0510-APE0536, undated, 27 pages.

Schematic drawings, Ref Nos. APE01038, APE01039, APE0339, undated, 2 pages.

Shanghai Jintai SEMW, undated, 8 pages.

www.mmsonline.com/columns/micro-keying-keeps-a-better-grip.aspx, Seibert, Stan, Modern Machine Shop: "Micro-Keying Keeps a Better Grip," Aug. 1, 1992, 2 pages.

* cited by examiner

HYDRAULIC IMPACT HAMMER SYSTEMS AND METHODS

TECHNICAL FIELD

The present invention relates to systems and methods for striking objects, such as piles, and, in particular, to systems and methods for allowing a diesel hammer to be used as a hydraulic impact hammer.

BACKGROUND

In construction, objects such as piles are often inserted into the earth. Such insertion may be by placement of a pile into an excavated hole, but it is typically quicker and more efficient to simply insert the pile into the earth without prior excavation. Such insertion may be by auguring the pile into the earth, crowding (forcing) the pile into the earth with constant pressure, applying a vibrational driving force to the pile, by striking the pile with repeated blows on an upper end of the pile, commonly referred to as hammering, or by combinations of those methods.

Another common construction task is to test the load bearing capacity of a pile that has been driven into the earth. In a particular, information obtained by striking a driven pile with a controlled striking force can be used to test and/or confirm the load bearing capacity of the driven pile.

The present invention relates to systems and methods for striking a pile for the purpose of driving the pile into the earth and/or testing a load capacity of a pile that has been driven into the earth. In the following discussion, the term "strike" will be used to refer to the act of impacting or applying a force to a pile for the purpose of driving the pile and/or for the purpose of testing the load bearing capacity of a driven pile.

Pile hammer systems typically employ a heavy ram member that is raised and allowed to fall such that the ram member repeatedly applies a short duration striking force directly or indirectly to the pile. A number of mechanisms are used to raise the ram member.

One type of pile hammer is commonly referred to as a diesel hammer. A diesel hammer injects diesel fuel below the falling ram such that the falling ram compresses and then ignites the diesel fuel as the ram applies the driving force to the pile. After the driving force has been applied to the pile, the ignited diesel fuel expands and forces the ram up to repeat the cycle.

Another type of pile hammer is commonly referred to as a hydraulic impact hammer. A hydraulic impact hammer uses a hydraulic actuator to raise the ram and force the ram down against the pile.

One type of pile hammer may be preferred over another depending on factors as the specifications of the pile to be struck, the purpose for applying the striking force to the pile (e.g., driving or load testing), and soil conditions. Often, it is desirable to change from one type of pile hammer to another type of pile hammer, sometimes for the same pile at the same location. For example, it may be desirable to use a diesel hammer to a certain soil depth and a hydraulic impact hammer beyond that depth, or vice versa. As another example, it may be desirable to use a diesel hammer to drive the pile to a predetermined depth and a hydraulic impact hammer to test the load bearing capacity of the pile at the predetermined depth.

The need exists for systems and methods that facilitate the change from one type of pile hammering to another type of pile hammering.

SUMMARY

The present invention may be embodied as a hydraulic impact hammer for striking a pile comprising a main housing, a ram supported for movement within the main housing, a coupler rod detachably attached to the ram, a conversion housing detachably attached to the main housing, a hydraulic actuator supported by the conversion housing, the hydraulic actuator defining an actuator rod, a lifting head, a lift connector, and a ram connector. The lift connector is detachably attaches the actuator rod to the lifting head. The ram connector detachably attaches the coupler rod to the lifting head. Operation of the hydraulic actuator raises and lowers the ram to strike the pile.

The present invention may also be embodied as a pile striking system for striking at least one pile. The pile striking system comprises a main housing, a valve assembly supported by the main housing, an anvil supported by the main housing, a ram supported for movement within the main housing, a cap detachably attachable to the main housing, a coupler rod detachably attachable to the ram, a conversion housing detachably attachable to the main housing, a hydraulic actuator supported by the conversion housing, the hydraulic actuator defining an actuator rod, a lifting head, a lift connector, and a ram connector. The lift connector detachably attaches the actuator rod to the lifting head. The ram connector detachably attaches the coupler rod to the lifting head. The cap is attached to the main housing and the valve assembly is configured to operate in a diesel mode such that the pile striking system to operate as a diesel hammer to cause the ram to impact the anvil to strike at least one pile. The conversion housing is attached to the main housing, the coupler rod is attached to the ram and to the ram and to the lifting head by the ram connector, the actuator rod is detachably attached to the lifting head by the lift connector, the valve assembly is configured to operate in a hydraulic mode, and operation of the hydraulic actuator raises and lowers the ram such that the pile striking system operates as a hydraulic impact hammer to cause the ram to impact the anvil to strike at least one pile.

The present invention may also be embodied as a method of striking a pile comprising the following steps. A ram is supported for movement within a main housing. A coupler rod is detachably attached to the ram. A conversion housing is detachably attached to the main housing. A hydraulic actuator defining an actuator rod is supported from the conversion housing. The actuator rod is detachably attached to a lifting head. The coupler rod is detachably attached to the lifting head. The hydraulic actuator is operated to raise and lower the ram to strike the pile.

The present invention may also be embodied as a method of striking at least one pile comprising the following steps. A valve assembly is supported from a main housing. A ram is supported for movement within the main housing. A hydraulic actuator defining an actuator rod is provided. The pile striking system is operated as a diesel hammer by attaching a cap to the main housing and configuring a valve assembly to operate in a diesel mode to cause the ram to impact an anvil to strike at least one pile. The pile striking system is operated as a hydraulic impact hammer by attaching a conversion housing to the main housing, attaching a coupler rod to the ram, attaching the coupler rod to a lifting head, attaching the actuator rod to the lifting head, configuring the valve assembly to operate in a hydraulic mode, and operating the hydraulic actuator to raise and lower the ram to cause the ram to impact the anvil and strike at least one pile.

DETAILED DESCRIPTION

Figure 1:
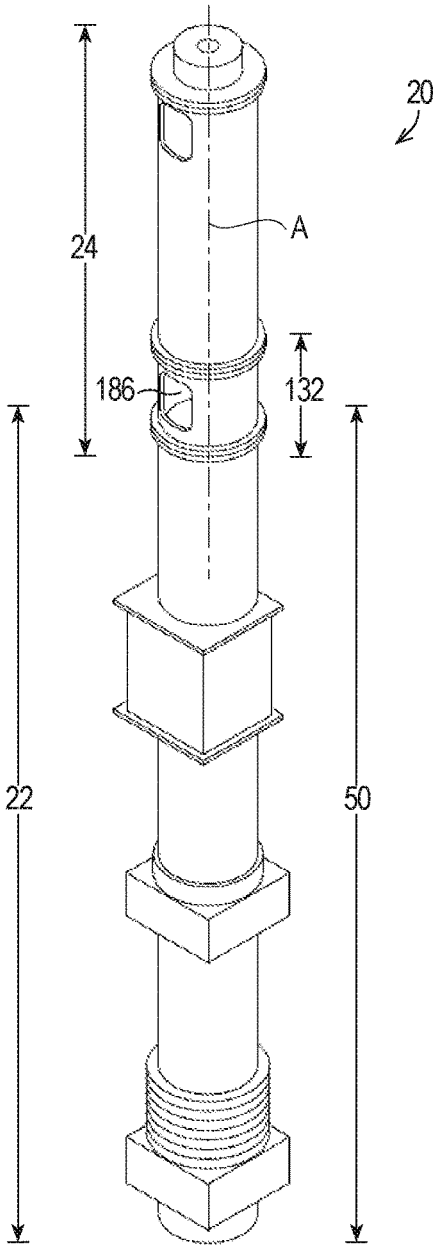
FIG. 1 is a perspective view of a first example hydraulic impact hammer of the present invention.
Figure 1A:
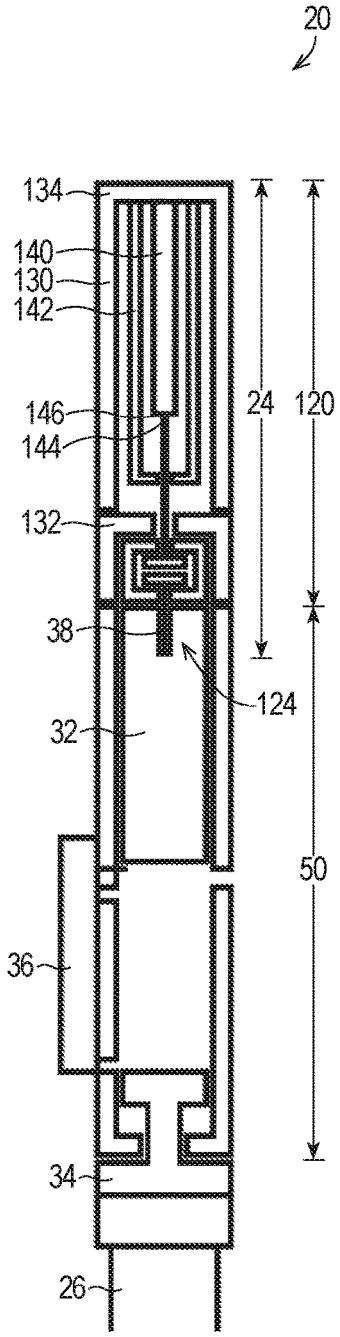
FIGS. 1A and 1B are highly schematic elevation section views of the first example hydraulic impact hammer illustrating a ram in upper and impact positions, respectively.
Figure 1B:
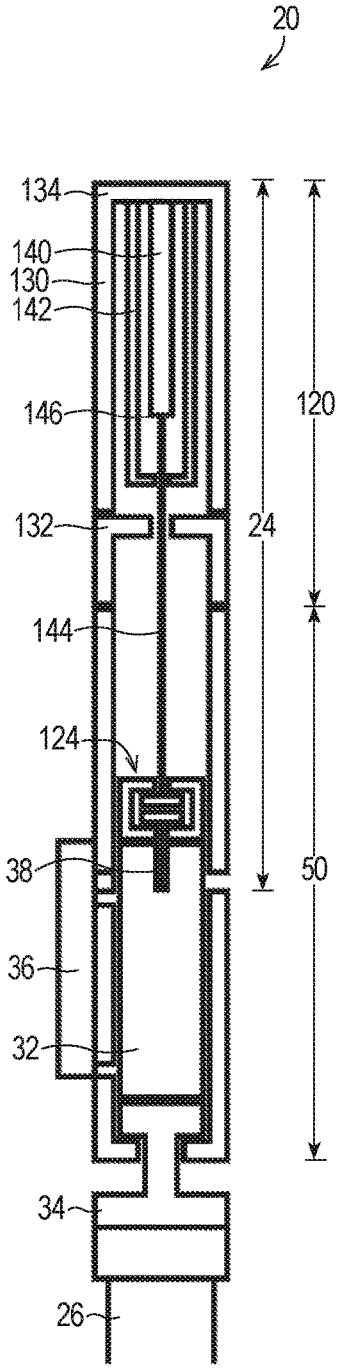
Figure 2:
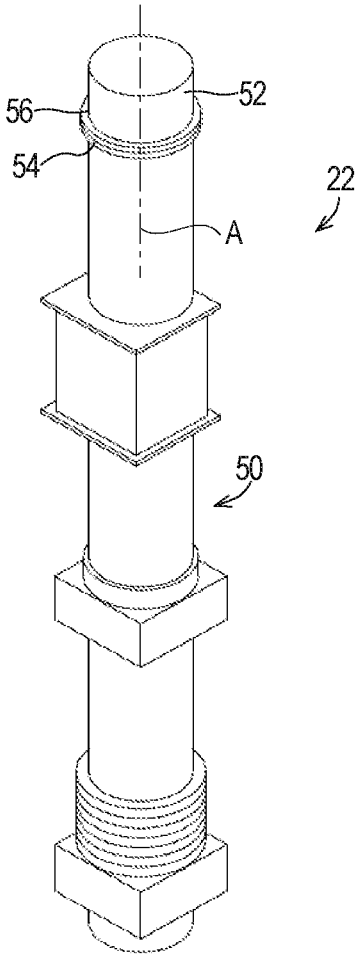
FIG. 2 (PRIOR ART)
FIG. 2 is a perspective view of a conventional diesel hammer a portion of which forms a part of the first example hydraulic impact hammer of FIG. 1.
Figure 2A:
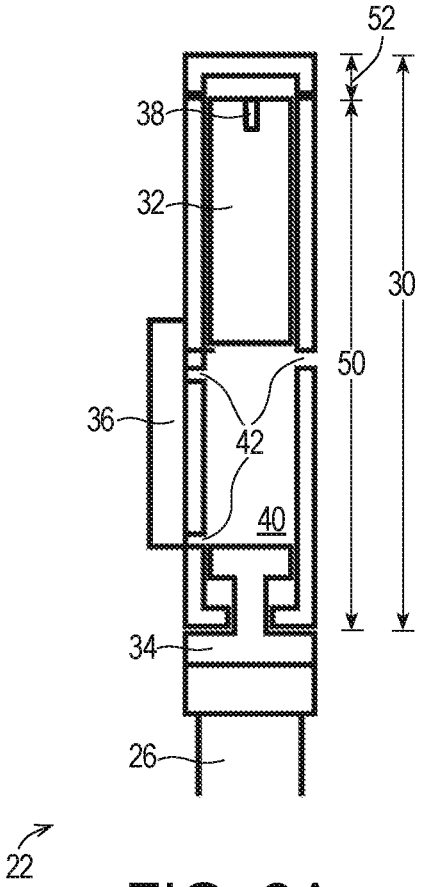
FIG. 2A (PRIOR ART)
FIGS. 2A and 2B are highly schematic elevation section views of the example diesel hammer illustrating the ram in upper and impact positions, respectively.
Figure 2B:
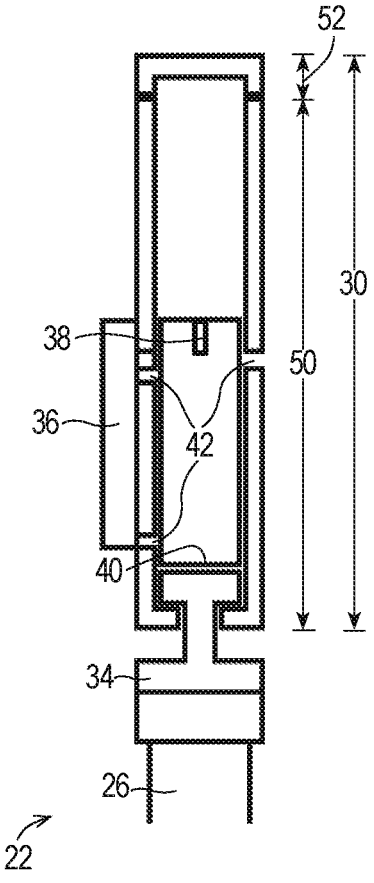
FIG. 2B (PRIOR ART)

Referring initially to FIGS. 1, 1B, 2, and 2B of the drawing, depicted in FIGS. 1 and 1B is a hydraulic impact hammer 20 constructed in accordance with, and embodying, the principles of the present invention. FIGS. 2 and 2B illustrate a conventional diesel hammer 22 capable of operating in a diesel hammer mode. The first example hydraulic impact hammer 20 comprises a conversion assembly 24 configured to allow certain elements of the diesel hammer 22 to be operated in a hydraulic impact hammer mode. FIGS. 1A, 1B, 2A, and 2B illustrate that either one or both of the hydraulic impact hammer 20 and the diesel hammer 22 may be used to strike a pile 26 along a strike axis A.

The example diesel hammer 22 is or may be conventional and will be described herein only to that extent helpful to a complete understanding of the present invention. As perhaps best shown in FIGS. 2A and 2B, the example diesel hammer 22 comprises a diesel housing 30, a ram 32, an anvil 34, a valve assembly 36. A threaded bore 38 is formed in an upper end of the ram 32. A diesel chamber 40 is formed by the diesel housing 30 and the ram 32. Ports 42 are formed in the diesel housing 30.

The ram 32 is configured to move between upper and impact positions within the diesel housing 30 as shown by a comparison of FIGS. 2A and 2B. As shown in FIG. 2B, in its impact position the ram 32 indirectly engages the pile 26 through the anvil 34 in a conventional manner to apply a striking force to the pile 26.

When the example valve assembly 36 is configured in a diesel hammer mode, the ram 32 moves through a diesel impact cycle. At an initial point in the diesel impact cycle, the ram 32 is in the upper position as shown in FIG. 2A. As the ram 32 falls from the upper position towards the impact position, the valve assembly 36 is operated in a conventional manner to open and/or close one or more of the ports 42 and to seal the diesel chamber 40 while injecting diesel fuel into the diesel chamber 40. The falling ram 32 compresses and ignites diesel fuel within the sealed diesel chamber 40. When the ram 32 engages the anvil 34, a striking force is applied to the pile 26 to strike the pile 26 downward as shown by a comparison of FIGS. 2A and 2B. The ignited diesel fuel then expands and forces the ram 32 from the impact position back into the upper position, completing the diesel impact cycle.

The example valve assembly 36 of the example diesel hammer 22 may further be configured to operate a hydraulic mode. As will be described in further detail below, in the hydraulic mode the ram 32 is allowed to move between the upper and lower positions without injection of diesel fuel and with minor controlled compression of fluids (e.g., air) within the diesel chamber 40 for the purpose of pre-compression as described, for example, in U.S. Pat. Nos. 7,694,747, 8,181,713, and 8,496,072. In particular, in the hydraulic mode the valve assembly 36 is configured to allow air within the diesel chamber 40 to flow out such that movement of the ram 32 from the upper position to the lower position is impeded only by resistance of compressed air sufficient to establish pre-compression of the anvil 34 against the pile 26 immediately prior to the striking of the anvil 34 by the ram 32. As described in the U.S. Pat. Nos. 7,694,747, 8,181,713, and 8,496,072 patents, this pre-compression inhibits transmission of potentially damaging shocks into the pile 26. However, the example hydraulic impact hammer 20 may be operated such that the ram 32 strikes the anvil 34 without pre-compression when operated in the hydraulic mode.

FIGS. 2, 2A, and 2B further illustrate that the example diesel housing 30 comprises a main housing 50 and a cap 52. The cap 52 is detachably attached to the main housing 50 to selectively allow and prevent access to the interior of the diesel housing 30. In the example diesel hammer 22, the main housing 50 defines a main flange 54, and the cap 52 defines a cap flange 56. Bolts, threads, or the like (not shown) are used to connect the cap flange 56 to the main flange 54 to detachably attach the cap 52 to the main housing 50.

Given the foregoing understanding of the construction and operation of the example diesel hammer 22, the construction and operation of the first example hydraulic impact hammer 20 will now be generally described with reference to FIGS. 1, 1A, and 1B.

Initially, the diesel hammer 22 is reconfigured to allow the diesel hammer to be combined with the conversion assembly 24 to form the first example hydraulic impact hammer 20. The diesel hammer 22 is reconfigured by removing the cap 52 of the diesel housing 30. As will be described below, all components of the diesel hammer 22 except for the cap 52 are combined with the conversion assembly 24 to form the first example hydraulic impact hammer 20.

The example conversion assembly 24 comprises a conversion housing 120, a hydraulic actuator 122, and a coupler assembly 124. The conversion housing 120 supports the hydraulic actuator 122 in a desired position relative to the ram 32 when at least a portion of the diesel hammer 22 is combined with the conversion assembly 24. With the hydraulic actuator 122 in a desired position relative to the ram 32, the example coupler assembly 124 detachably attaches the hydraulic actuator 122 to the ram 32 to complete assembly of the hydraulic impact hammer 20.

The example conversion housing 120 comprises an upper portion 130, a transition portion 132, and a top plate 134. The transition portion 132 is adapted to be detachably attached to the main housing 50 of the diesel housing 30 of the diesel hammer 22. The upper portion 130 is adapted to be attached to the transition portion 132. The top plate 134 is adapted to the attached to the upper portion 130.

Figure 3:
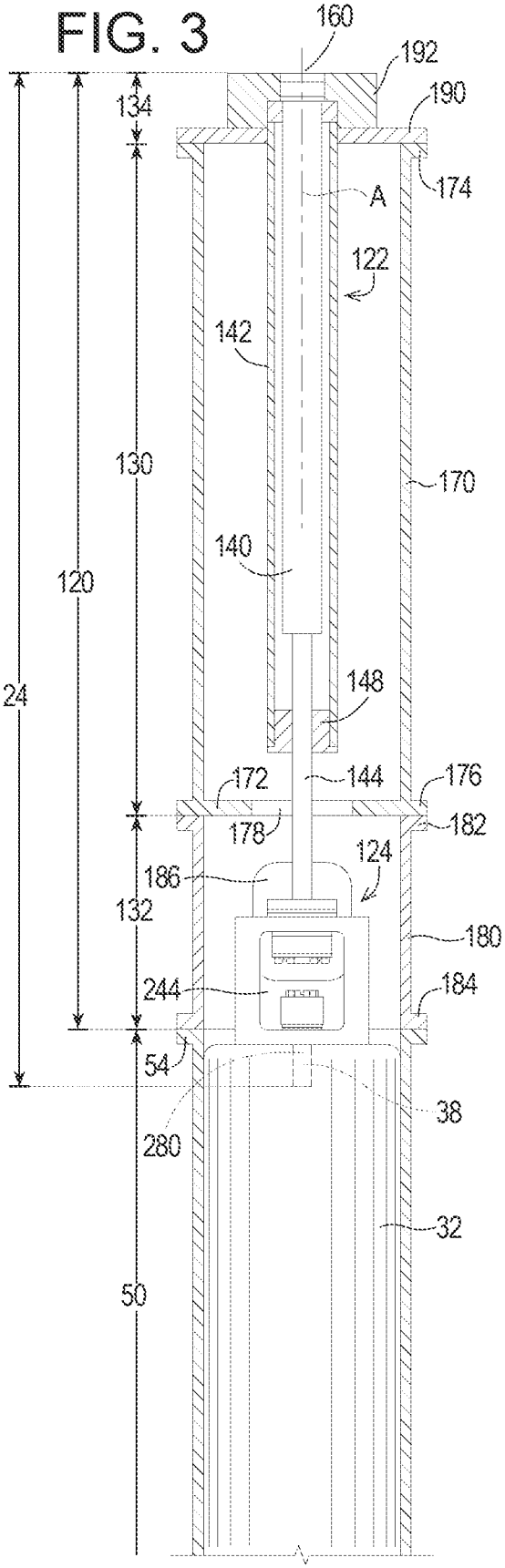
FIG. 3 is a front elevation partial section view of the first example hydraulic impact hammer illustrating the ram in the upper position.
Figure 4:
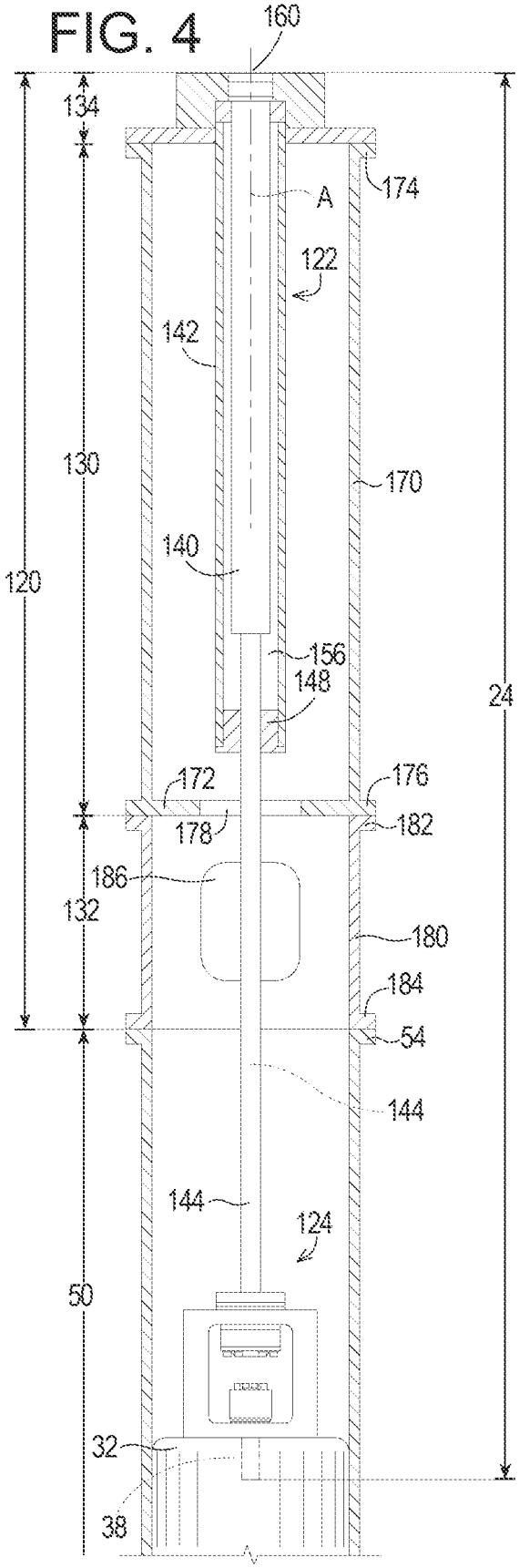
FIG. 4 is a front elevation partial section view of the first example hydraulic impact hammer illustrating the ram in the impact position.
Figure 5:
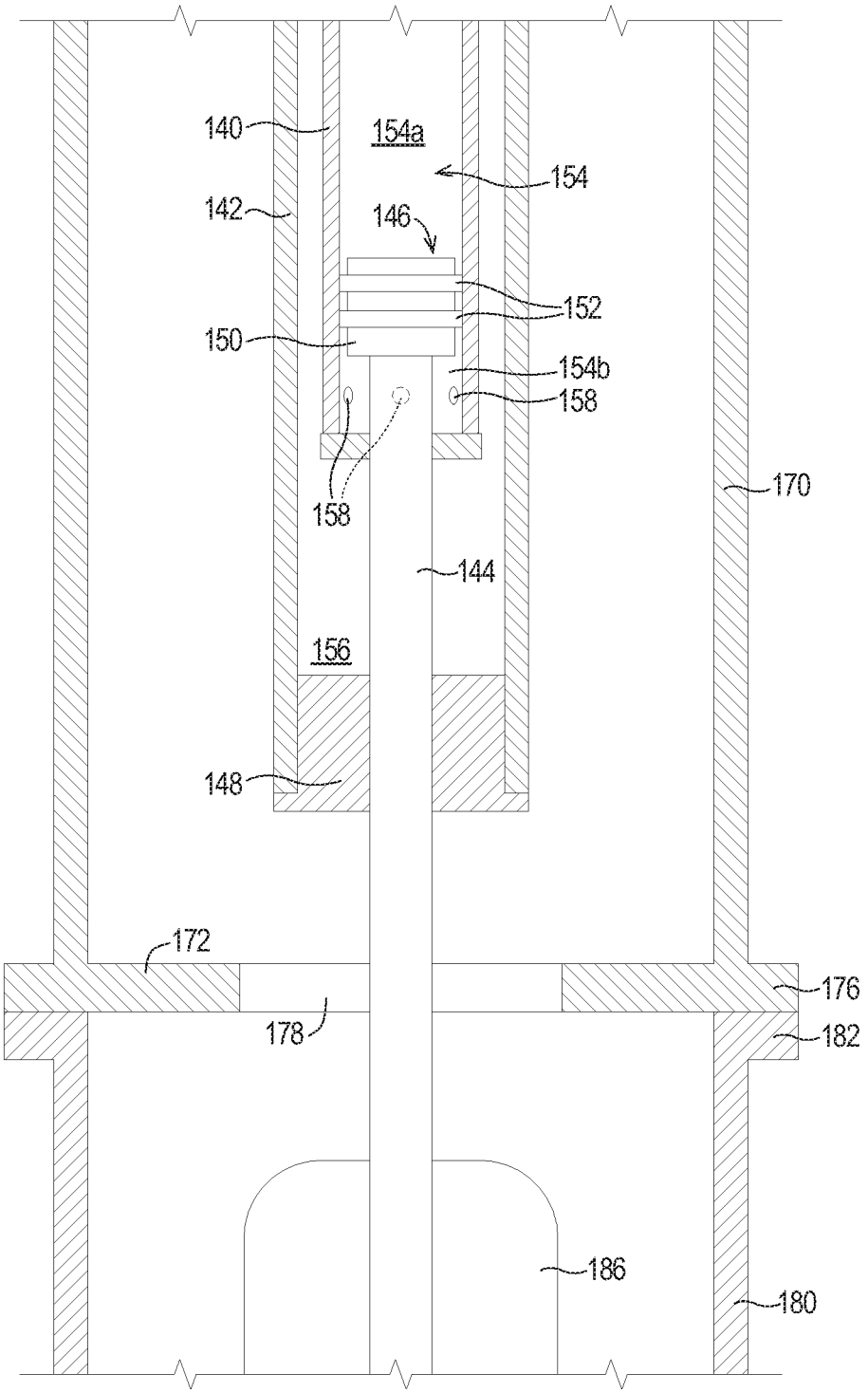
FIG. 5 is a front elevation partial section view illustrating details of an example hydraulic actuator of the first example hydraulic impact hammer.

As perhaps best shown in FIGS. 3-5, the example hydraulic actuator 122 comprises an inner cylinder 140, an outer cylinder 142, an actuator rod 144, a piston 146, and a seal 148. The example piston 146 comprises a piston head 150 secured to one end of the actuator rod 144 and one or more piston rings 152 supported between the piston head 150 and the inner cylinder 140. The inner cylinder 140 and outer cylinder 142 are supported by the top plate 134 such that the inner cylinder 140 is coaxially arranged within the outer cylinder 142. The top plate 134 is attached to the upper portion 130 of the conversion housing 120, and the conversion housing 120 is attached to the main housing 50 of the diesel housing 30. In this configuration, the inner cylinder 140, the outer cylinder 142, and the actuator rod 144 are coaxially arranged within the upper portion 130 of the conversion housing 120 along the strike axis A.

The seal 148 is configured between the inner and outer cylinders 140 and 142 to define an inner chamber 154 and an outer chamber 156. The piston 146 is arranged within the inner chamber 154 to define a first inner chamber portion 154*a* and a second inner chamber portion 154*b*. One or more cylinder ports 158 (FIG. 5) are formed in the outer cylinder 142 to allow fluid communication between the second inner chamber portion 154*b* and the outer chamber 156. The piston rings 152 substantially prevent fluid flow between the first and second inner chamber portions 154*a* and 154*b*.

One or more actuator ports 160 (FIGS. 3 and 4) are formed in the top plate 134 to allow hydraulic fluid to be forced into and out of the first inner chamber portion 154*a* and the outer cylinder chamber 156 to cause the piston 146 to move the actuator rod 144 between a first position (FIGS. 2A and 3) and an a second position (FIGS. 2B and 4). In particular, forcing hydraulic fluid into the outer chamber 156, through the actuator ports 160, and into the second inner chamber portion 154*b* causes the piston 146 to move the actuator rod 144 from the second position to the first position. Allowing fluid to flow out of the outer chamber portion 156 allows gravity to cause the piston 146 and actuator rod 144 to move from the first position to the second position. The use of hydraulic fluid to operate the hydraulic actuator 122 as described herein is conventional and will not be described beyond that extent helpful for a complete understanding of the invention.

As best shown in FIGS. 3 and 4, the example upper portion 130 of the conversion housing 120 comprises a first wall 170, a lower wall 172, a first wall upper flange 174, and a first wall lower flange 176. A rod opening 178 is formed in the lower wall 172. The example transition portion 132 of the conversion housing 120 comprises a second wall 180, a second wall upper flange 182, a second wall lower flange 184, and at least one outer opening 186. As shown in FIGS. 3 and 4, the example top plate 134 comprises a main plate portion 190 and a port block portion 192. The actuator ports 160 are formed in the port block portion.

To assemble the first example hydraulic impact hammer 20, the transition portion 132 thereof is detachably attached to the main housing 50 of the diesel housing 30, the upper portion of the conversion housing 120 is attached to the transition portion 132 thereof, and the top plate 134 is detachably attached to the upper portion 130 to complete assembly of the conversion housing 120. In the example conversion housing 120, the second lower flange 184 of the transition portion 132 is detachably attached to the main flange 54 of the main portion of the diesel housing 30 by bolts, threads, or the like, the second upper flange 182 is detachably attached to the first lower flange 176 by bolts, threads, or the like, and the top plate 134 is detachably attached to the first upper flange 174 by bolts, threads, or the like.

Bolts (not shown) are typically used to assemble the conversion housing 120 and to detachably attach the conversion housing 120 to the main housing 50 of the diesel housing 30. In this case, a plurality of bolts are arranged to extend at least partly through holes (not shown) in the flanges 54, 184, 182, 176, and 174 and main plate portion 190 at evenly spaced locations about the perimeter of these components. The bolts may be threaded into such holes or may pass through the holes and secured by nuts. The bolts should be of sufficient size and number to securely and rigidly hold the various components 50, 130, 132, and 134 together during normal use of the first example hydraulic impact hammer 20. Permanent connections such as welds may be used to attach two or more of the components 130, 132, and 134 if convenient. But the attachment of the transition portion 132 of the conversion housing 120 to the main housing 50 of the diesel housing 30 should be by non-permanent connection such as bolts, threading, clamps, or the like to allow the transition portion 132 to be detachably attached to the main portion 50.

Figure 6:
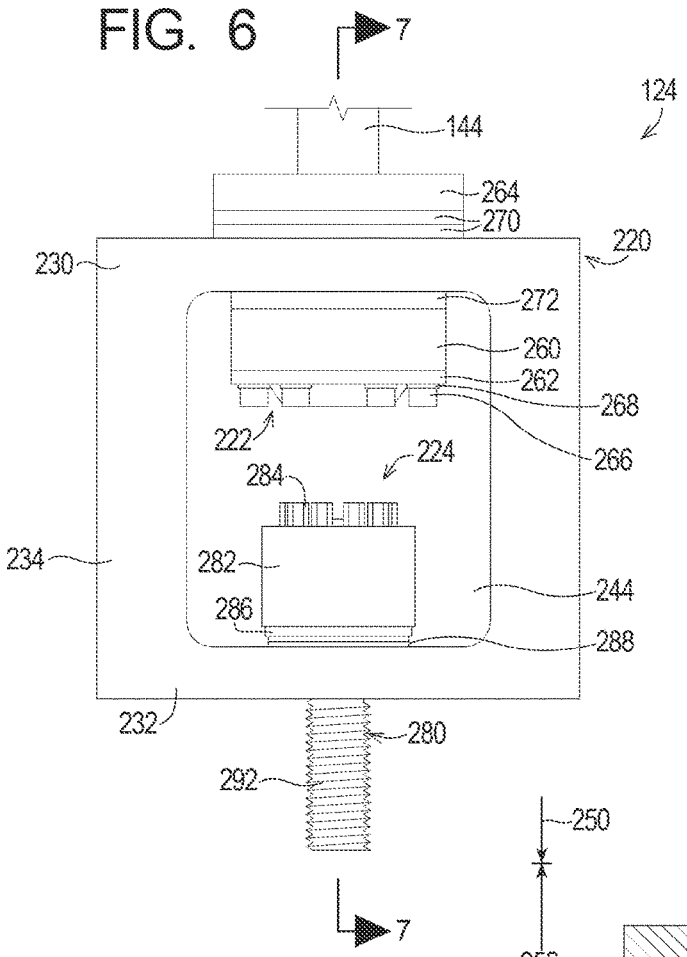
FIG. 6 is a front elevation view illustrating an example coupler assembly of the first example hydraulic impact hammer.
Figure 7:
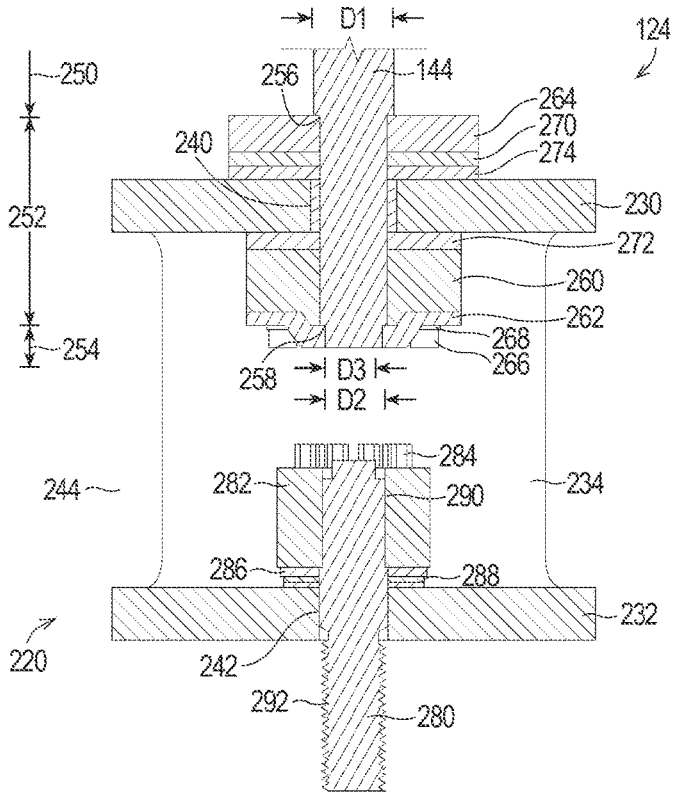
FIG. 7 is a front elevation section view illustrating the example coupler assembly of the first example hydraulic impact hammer.

Turning now to FIGS. 3, 4, 6, and 7 of the drawing, the construction and operation of the example coupler assembly 124 will be described in further detail. As best shown in FIGS. 6 and 7, the example coupler assembly 124 comprises a lifting head 220, a lift connector 222, and a ram connector 224. The example lifting head 220 defines a top wall 230, a bottom wall 232, and one or more side walls 234. An actuator rod opening 240 is formed in the top wall 230, and a ram rod opening 242 is formed in the bottom wall 232. One or more inner access openings 244 are formed in the side wall 234.

The example actuator rod 144 is configured to be detachably attached to the second example coupler assembly 124. In particular, the example actuator rod 144 defines a main portion 250 having a diameter D1, an intermediate portion 252 having a diameter D2, and a distal end portion 254 having a diameter D3. The diameter D1 is greater than the diameter D2, and the diameter D2 is greater than the diameter D3. The example intermediate portion 252 is threaded. A first shoulder surface 256 is formed at the juncture of the main portion 250 and the intermediate portion 252 of the actuator rod 144. A second shoulder surface 258 is formed at the juncture of the intermediate portion 252 and the distal end portion 254 of the actuator rod 144.

In the example coupler assembly 124, the example lift connector 222 comprises a rod nut 260, a rod jam nut 262, a rod end washer 264, one or more socket cap screws 266, and one or more lock washers 268. One or more impact cushions 270 are arranged between the rod end washer 264 and an upper surface of the top wall 230, and a lifting cushion 272 is arranged between the rod nut 260 and a lower surface of the top wall 230. A bushing 274 is arranged around the intermediate portion 252 of the actuator rod 144 within the actuator rod opening 240 in the upper wall 230.

The example ram connector 224 comprises a coupler rod 280, a torque nut 282, a plurality of torque nut studs 284, a torque nut washer 286, and a disc spring 288. The example coupler rod 280 defines a first threaded end 290 and a second threaded end 292. The example ram connector 224 is formed by what is commonly referred to as a Superbolt torque nut assembly, but any connector assembly capable of functioning in a manner similar to that of the example Superbolt torque nut assembly may be used.

To assemble the hydraulic impact hammer 20, the cap 52 of the diesel housing 30 is removed from the main housing 50 thereof to expose the top of the ram 32. The second threaded end 292 of the coupler rod 280 is threaded into the threaded bore 38 of the ram 32 to secure the coupler rod 280 to the ram 32.

The conversion assembly 24 is then assembled as follows. The actuator rod 144 is initially inserted through the rod end washer 264, through the impact cushion(s) 270, through the bushing 274, and through the actuator rod opening 240 in the lifting head 220 such that the first shoulder surface 256 is in contact with the rod end washer 264, the impact cushions 270 are in contact with the upper surface of the lifting head top wall 230, and the intermediate actuator rod portion 252 and bushing 274 are within the ram rod opening 242. The lifting cushion 272 is then arranged over the intermediate portion 252 of the actuator rod 144. The rod nut 260 is then threaded onto the actuator rod intermediate portion 252 such that the lifting cushion 272 is held against the lower surface of the lifting head top wall 230. The rod end jam nut 262 is next arranged over the distal end portion 254 of the actuator rod 144, and the socket cap screws 266 are extended through the lock washers 268 and the rod end jam nut 262 and into the rod nut 260 to secure the rod end jam nut 262 in place. The distal end portion 154 of the actuator rod 144 is thus secured to the lifting head 220. The transition portion 132 of the conversion housing 120 is also attached to the upper portion 130 of the conversion housing 120.

At this point, the conversion assembly 24 is assembled and is attached to the diesel hammer 22 from which the cap 52 has been removed to form the hydraulic impact hammer 20. In particular, the conversion housing 120 is arranged such that the first threaded end 290 of the coupler rod 280, which has been secured to the ram 32, extends through the ram rod opening 242 in the lifting head bottom wall 232. The disc spring 288 and torque nut washer 286 are then arranged over the first threaded end 290 of the coupler rod 280. The torque nut 282 is then threaded onto the first threaded end 290 of the coupler rod 280, and the torque nut washers 286 and studs 284 are used to secure the torque nut 282 to the coupler rod 280.

The conversion housing 120 is detachably attached to the main housing 50 of the diesel housing 30 using bolts, threads, or the like. In the example hydraulic impact hammer 20, bolts are passed at least partly through one or both of the main flange 54 defined by the main housing 50 and the second lower flange 184 defined by the conversion housing 30 to detachably attach the conversion housing 120 to the main housing 50.

The outer and inner access openings 186 and 244 allow the socket cap screws 266 and torque nut studs 284 to be tightened with the conversion housing 120 attached to or otherwise held in place relative to the main housing 50. The lifting head 220, the lift connector 222, and the ram connector 224 allow the actuator rod 144 to be quickly and securely attached to the ram 32 with simple tools available in the field.

Further, the hydraulic impact hammer 20 can be easily and quickly converted back into the diesel hammer 22 simply by reversing the steps described above.

In the forgoing discussion, a particular sequence for combining the conversion assembly 24 with the diesel hammer 22 has been described. The exact sequence described is not essential to a given implementation of the present invention as a method of forming a hydraulic impact hammer, a method of converting a diesel hammer into a hydraulic impact hammer, or a method of converting a hydraulic impact hammer into a diesel hammer.

To use the example hydraulic impact hammer 20, the valve assembly 36 is configured in the hydraulic mode to allow the ram 32 to move between the upper and lower positions. The hydraulic actuator 122 is then operated raise and lower the ram 32. In its lowest position, the ram impacts the anvil 34 and thus the pile 26 to strike the pile 26 along the strike axis A.

What is claimed is:

1. A hydraulic impact hammer for striking a pile comprising:

a main housing;

a ram supported for movement within the main housing;

a coupler rod detachably attached to the ram;

a conversion housing detachably attached to the main housing;

a hydraulic actuator supported by the conversion housing, the hydraulic actuator defining an actuator rod;

a lifting head defining an upper wall defining an actuator rod opening, a lower wall defining a ram rod opening, and at least one side wall configured to define an at least one access opening;

a lift connector; and a ram connector comprises a rod nut configured to secure a distal end of the actuator rod relative to the lifting head; wherein with the actuator rod extending through the actuator rod opening, the lift connector is accessed through the at least one access opening and engaged with the actuator rod to detachably attach the actuator rod to the upper wall of the lifting head;

with the coupler rod extending through the ram rod opening, the ram connector is accessed through the at least one access opening and engaged with the coupler rod to detachably attach the ram to the lower wall of the lifting head; and with the actuator rod detachably attached to the upper wall of the lifting head and the ram detachably attached to the lower wall of the lifting head, operation of the hydraulic actuator raises and lowers the ram to strike the pile.

2. The hydraulic impact hammer as recited in claim 1, further comprising an anvil supported by the main housing, where the ram engages the anvil to strike the pile.

3. The hydraulic impact hammer as recited in claim 1, further comprising a valve assembly supported by the main housing, where the valve assembly is arranged in a hydraulic mode when the hydraulic actuator raises and lowers the ram.

4. The hydraulic impact hammer as recited in claim 1, in which the ram connector comprises a torque nut configured to secure a first threaded portion of the coupler rod to the lifting head.

5. The hydraulic impact hammer as recited in claim 1, in which a second threaded portion of the coupler rod is threaded into a threaded bore in the ram to detachably attach the coupler rod to the ram.

6. The hydraulic impact hammer as recited in claim 1, in which:

the lift connector comprises a rod nut configured to secure a distal end of the actuator rod relative to the lifting head;

the ram connector comprises a torque nut configured to secure a first threaded portion of the coupler rod to the lifting head; and a second threaded portion of the coupler rod is threaded into a threaded bore in the ram to detachably attach the coupler rod to the ram.

7. A pile striking system for striking at least one pile comprising:

a main housing;

a valve assembly supported by the main housing;

an anvil supported by the main housing;

a ram supported for movement within the main housing;

a cap detachably attachable to the main housing;

a coupler rod detachably attachable to the ram;

a conversion housing detachably attachable to the main housing;

a hydraulic actuator supported by the conversion housing, the hydraulic actuator defining an actuator rod;

a lifting head defining an upper wall defining an actuator rod opening, a lower wall defining a ram rod opening, and at least one side wall configured to define an at least one access opening;

a lift connector; and a ram connector wherein with the actuator rod extending through the actuator rod opening, the lift connector is accessed through the at least one access opening and between the upper and lower walls and is engaged with the actuator rod to detachably attach the actuator rod to the upper wall of the lifting head;

with the coupler rod extending through the ram rod opening, the ram connector is accessed through the at least one access opening and between the upper and lower walls and is engaged with the coupler rod to detachably attach the ram to the lower wall of the lifting head;

with the cap is attached to the main housing and the valve assembly is configured to operate in a diesel mode, the pile striking system operates as a diesel hammer to cause the ram to impact the anvil to strike the at least one pile; and with the conversion housing attached to the main housing, the coupler rod attached to the ram and to the lower wall of the lifting head by the ram connector, and the actuator rod detachably attached to the upper wall of the lifting head by the lift connector, the valve assembly is configured to operate in a hydraulic mode, and operation of the hydraulic actuator raises and lowers the ram such that the pile striking system operates as a hydraulic impact hammer to cause the ram to impact the anvil to strike the at least one pile.

8. The pile striking system as recited in claim 7, in which the lift connector comprises a rod nut configured to secure a distal end of the actuator rod relative to the lifting head.

9. The pile striking system as recited in claim 7, in which the ram connector comprises a torque nut configured to secure a first threaded portion of the coupler rod to the lifting head.

10. The pile striking system as recited in claim 7, in which a second threaded portion of the coupler rod is threaded into a threaded bore in the ram to detachably attach the coupler rod to the ram.

11. The pile striking system as recited in claim 7, in which:

the lift connector comprises a rod nut configured to secure a distal end of the actuator rod relative to the lifting head;

the ram connector comprises a torque nut configured to secure a first threaded portion of the coupler rod to the lifting head; and a second threaded portion of the coupler rod is threaded into a threaded bore in the ram to detachably attach the coupler rod to the ram.

12. A method of striking a pile comprising the steps of:

supporting a ram for movement within a main housing;

detachably attaching a coupler rod to the ram;

detachably attaching a conversion housing to the main housing;

supporting a hydraulic actuator defining an actuator rod from the conversion housing;

providing a lifting head defining an upper wall defining an actuator rod opening, a lower wall defining a ram rod opening, and at least one side wall configured to define an at least one access opening;

detachably attaching the actuator rod to the upper wall of the lifting head by extending the actuator rod through the actuator rod opening, and accessing a lift connector through the at least one access opening and between the upper and lower walls to engage the lift connector with the actuator rod to detachably attach the actuator rod to the upper wall of the lifting head comprising the step of securing a distal end of the actuator rod relative to the lifting head using a rod nut; and detachably attaching the coupler rod to the lower wall of the lifting head by extending the coupler rod through the ram rod opening, and accessing the ram connector through the at least one access opening and between the upper and lower walls to engage the ram connector with the coupler rod to detachably attach the ram to the lower wall of the lifting head; and with the actuator rod detachably attached to the upper wall of the lifting head and the ram detachably attached to the lower wall of the lifting head, operating the hydraulic actuator to raise and lower the ram to strike the pile.

13. The method as recited in claim 12, further comprising the step of arranging the ram to engage an anvil to strike the pile.

14. The method as recited in claim 12, further comprising the step of arranging a valve assembly in a hydraulic mode when the hydraulic actuator raises and lowers the ram.

15. The method as recited in claim 12, in which the step of detachably attaching the coupler rod to the lifting head comprises the step of securing a first threaded portion of the coupler rod relative to the lifting head using a torque nut.

16. The method as recited in claim 12, in which the step of detachably attaching the coupler rod to the ram comprises the steps of:

forming a threaded bore in the ram; and threading a second threaded portion of the coupler rod into the threaded bore in the ram.

17. The method as recited in claim 12, in which:

the step of detachably attaching the actuator rod to the lifting head comprises the step of securing a distal end of the actuator rod relative to the lifting head using a rod nut;

the step of detachably attaching the coupler rod to the lifting head comprises the step of securing a first threaded portion of the coupler rod relative to the lifting head using a torque nut; and the step of detachably attaching the coupler rod to the ram comprises the steps of forming a threaded bore in the ram, and threading a second threaded portion of the coupler rod into the threaded bore in the ram.

18. A method of striking at least one pile comprising the steps of:

supporting a valve assembly from a main housing;

supporting a ram for movement within the main housing;

providing a hydraulic actuator defining an actuator rod;

providing a lifting head defining an upper wall defining an actuator rod opening, a lower wall defining a ram rod opening, and at least one side wall configured to define an at least one access opening;

operating in a diesel mode by attaching a cap to the main housing and configuring the valve assembly to operate in a diesel mode to cause the ram to impact an anvil to strike the at least one pile; and operating in a hydraulic impact mode by attaching a conversion housing to the main housing, attaching a coupler rod to the ram, attaching the coupler rod to the lower wall of the lifting head by extending the actuator rod through the actuator rod opening, accessing the lift connector through the at least one access opening and between the upper and lower walls to engage a lift connector with the actuator rod to detachably attach the actuator rod to the upper wall of the lifting head, attaching the actuator rod to the upper wall of the lifting head by extending the coupler rod through the ram rod opening, and accessing the ram connector through the at least one access opening and between the upper and lower walls to engage the ram connector with the coupler rod to detachably attach the ram to the lower wall of the lifting head, configuring the valve assembly to operate in the hydraulic impact mode, and operating the hydraulic actuator to raise and lower the ram to cause the ram to impact the anvil and strike the at least one pile.

* * * * *